US005899261A

United States Patent [19]

Brzytwa et al.

[11] Patent Number: 5,899,261

[45] Date of Patent: May 4, 1999

[54] AIR PREHEATER HEAT TRANSFER SURFACE

[75] Inventors: Tadek Casimir Brzytwa; Wayne S. Counterman; James David Seebald, all of Wellsville, N.Y.

[73] Assignee: ABB Air Preheater, Inc., Wellsville, N.Y.

[21] Appl. No.: 08/929,037

[22] Filed: Sep. 15, 1997

[51] Int. Cl.[6] ..... F23L 15/02

[52] U.S. Cl. ..... 165/8; 165/10; 165/6

[58] Field of Search ..... 165/8, 9, 10, 6, 165/4, 5

[56] References Cited

U.S. PATENT DOCUMENTS

| | | | |
|---|---|---|---|
| 2,023,965 | 12/1935 | Lysholm | 165/10 |
| 2,596,642 | 5/1952 | Boestad . | |
| 2,696,976 | 12/1954 | Boestad et al. | 165/10 |
| 2,940,736 | 6/1960 | Ödman . | |
| 3,554,273 | 1/1971 | Kritzler | 165/10 X |
| 3,756,310 | 9/1973 | Becker | 165/10 X |
| 3,910,344 | 10/1975 | Hagen | 165/10 |
| 4,345,640 | 8/1982 | Cullinan . | |
| 4,396,058 | 8/1983 | Kurschner et al. | 165/10 X |
| 4,449,573 | 5/1984 | Pettersson et al. | 165/10 |
| 4,953,629 | 9/1990 | Karlsson et al. | 165/8 X |
| 5,318,102 | 6/1994 | Spokoyny et al. | 165/10 |

FOREIGN PATENT DOCUMENTS

| | | | |
|---|---|---|---|
| 334437 | 9/1970 | U.S.S.R. | 165/10 |
| 668476 | 3/1952 | United Kingdom . | |

*Primary Examiner*—Ira S. Lazarus
*Assistant Examiner*—Christopher Atkinson
*Attorney, Agent, or Firm*—Alix, Yale & Ristas, LLP

[57] ABSTRACT

A heat exchange element for an air preheater has first and second heat transfer elements arranged to form channels for the passage of a heat exchange media having a main flow direction. Each of the heat exchange plates has parallel straight ridges and flats between the ridges. The ridges alternate to extend transversely from opposite sides of each heat transfer plate. The ridges of the adjacent plates are oriented obliquely in opposite directions relative to the main flow direction and contact each other solely at points of intersection of the ridges.

2 Claims, 5 Drawing Sheets

AIR PREHEATER HEAT TRANSFER SURFACE

BACKGROUND OF THE INVENTION

The present invention relates to rotary regenerative air preheaters for the transfer of heat from a flue gas stream to a combustion air stream. More particularly, the present invention relates to the heat transfer surface of an air preheater.

Rotary regenerative air preheaters are commonly used to transfer heat from the flue gases exiting a furnace to the incoming combustion air. Conventional rotary regenerative air preheaters have a rotor rotatably mounted in a housing. The rotor supports heat transfer surfaces defined by heat transfer elements for the transfer of heat from the flue gases to the combustion air. The rotor has radial partitions or diaphragms defining compartments therebetween for supporting the heat transfer elements. Sector plates extend across the upper and lower faces of the rotor to divide the preheater into a gas sector and at least one air sector. The hot flue gas stream is directed through the gas sector of the preheater and transfers heat to the heat transfer elements on the continuously rotating rotor. The heated heat transfer elements are then rotated to the air sector of the preheater. The combustion air stream directed over the heat transfer elements is thereby heated.

Heat transfer elements for regenerative air preheaters have several requirements. Most importantly, the heat transfer elements must provide the required quantity of heat transfer or energy recovery for a given depth of the heat transfer element. Conventional heat transfer elements for air preheaters comprise a combination of various types of flat and/or form-pressed steel plates which are stacked in spaced relationship in heat exchange modules referred to as baskets. These spaced plates form generally longitudinal passages or channels for the flow of the flue gas stream and the air stream through the rotor. The surface design and arrangement of the heat transfer plates provides contact between adjacent plates to define and maintain the passages or channels. Further requirements for the heat transfer elements are that the stack of heat transfer elements produce minimal pressure drop for a given depth of the heat transfer elements, and furthermore, fit within a small volume.

Heat transfer element surfaces have been designed and manufactured according to many methods and geometries over the past 60 or more years. Many attempts have been made to develop new profiles which provide high levels of heat transfer with low pressure drops, and ones which are less prone to fouling, easier to clean, and not easily damaged by soot blowing. One such surface considered with excellent heat transfer and low pressure drop is shown in U.S. Pat. 4,449,573. That profile consists of a pack of heat transfer plates that are all of the same profile. The plates are provided with notches that extend obliquely to the main direction of flow. The plates are positioned such that the notches of one plate cross the notches of the second plate. The notches are parallel double ridges extending transversely from the opposite sides of a heat transfer plate. Therefore each notch forms on each surface of a heat transfer plate a peak and an immediately adjacent valley. The notches serve at least two beneficial functions, first to keep the heat transfer plates separated by a known and uniform distance. Second, the notches increase the rate of heat transfer by periodically disrupting the thermal boundary layer that forms in a flowing fluid medium over the surface of the heat transfer plate. In this manner the plates are in contact with each other only at the points spaced along the crest of the notches. While that is an improvement over the past surfaces, it does have certain disadvantages. It is difficult to clean since all particulate tends to be driven off to one side at an angle. There is no opening in the bulk direction of flow for particles, water jets or soot blowing jets. It cannot be packed loosely in a basket since the angled notches do not provide sufficient structural strength to survive the vibrations induced by soot blowing if the sheets are not snugly supported by contact with adjacent sheets. Since there is no straight line of sight through the element, an infrared or hot spot detection system is unable to detect infrared radiation at any significant depth of element. Hence there is no way to sense a hot spot condition within or downstream from the element pack.

The oblique notch described in U.S. Pat. No. 4,449,573 serves to disrupt the thermal boundary layer in the fluid and thereby increase the rate of heat transfer. In a fluid mechanics sense, the oblique notch is essentially equivalent to a uniform, periodic roughness on the surface of the plate. However, since both the plate spacing and the roughness height are proportional to the oblique notch height, it is impossible to vary the height of the roughness independently of the plate spacing. This precludes the possibility of optimizing the ratio of roughness to plate spacing. This type of optimization has been reported on in the heat transfer literature as an optimization of the ratio $H/D_h$, where H is the roughness height and $D_h$ is the hydraulic diameter of the channel. The hydraulic diameter has units of length, and is defined as four times the ratio of the flow area divided by the wetted perimeter of the channel. For infinite, parallel flat plates, $D_h$ is equal to twice the opening between plates. For the plates of U.S. Pat. No. 4,449,573, the height of the oblique notch above the flat sheet would be H, so that the channel opening would be 2H. The $D_h$ would be approximately twice the channel opening, or 4H. This means that the ratio $H/D_h$ would always be approximately 0.25, no matter what the value of H was.

If the plate spacing could be changed independently of the roughness height, the diameter of the air preheater can be reduced so it can operate at a higher flow velocity while maintaining the same thermal recovery and pressure drop. Under these constraints, a larger plate spacing is necessary, and the result is a smaller diameter and deeper air preheater, possibly having more element weight since the larger plate spacing would typically result in lower turbulence even at the higher velocities. There are installations where this is desirable since it provides lower fouling at a higher velocity. However, with the plates of U.S. Pat. No. 4,449,573, an increased plate spacing can only be achieved by increasing the oblique notch height. At the higher velocities the higher oblique notch height produces a disproportionate pressure drop increase.

SUMMARY OF THE INVENTION

Briefly stated, the invention is an improved heat transfer element for the transfer of heat from a flue gas stream to an air stream in a rotary regenerative air preheater. The heat transfer element comprises a pack of heat transfer plates that all have the same profile with each plate being provided with two types of notches. Each notch is formed by adjacent ridges extending from opposite sides of the heat transfer plate.

The first series of notches are parallel spaced straight notches running in the direction of the nominal flow direction, i.e., running generally straight in the direction from one face of the rotor to the other face. The second series of notches are the oblique or angled notches which are spaced apart from each other by flat sections and which extend between the straight notches. The height of the straight notches is equal to and preferably greater than the height of the angled notches such that the straight notches make contact with the crests of the angled notches and provide the plate spacing and support.

BRIEF DESRCIPTION OF THE DRAWINGS

DESCRIPTION OF THE PREFERRED EMBODIMENT

Figure 1:
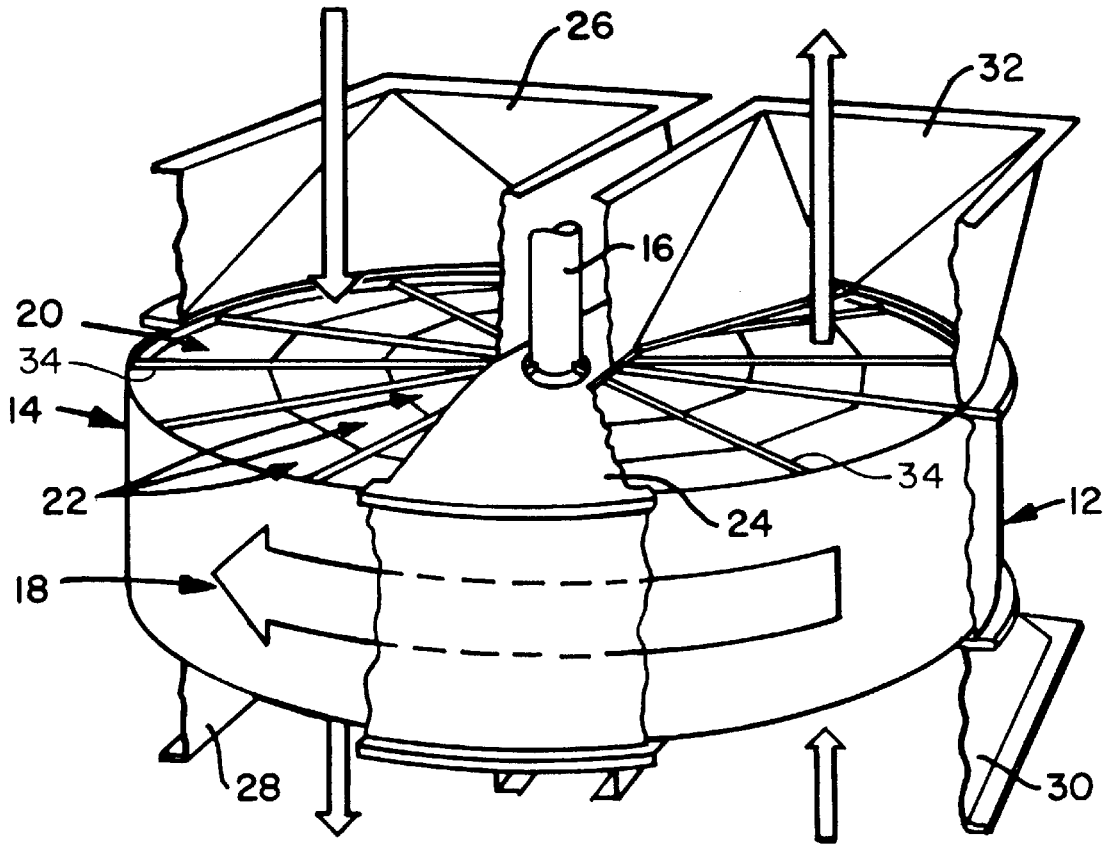
FIG. 1 is a partially broken away, general perspective view of a rotary regenerative air preheater.

FIG. 1 of the drawings is a partially cut-away perspective view of a typical air heater showing a housing 12 in which the rotor 14 is mounted on drive shaft or post 16 for rotation as indicated by the arrow 18. The rotor is composed of a plurality of sectors 20 with each sector containing a number of basket modules 22 and with each sector being defined by the diaphragms 34. The basket modules contain the heat exchange surface. The housing is divided by means of the flow impervious sector plate 24 into a flue gas side and an air side. A corresponding sector plate is also located on the bottom of the unit. The hot flue gases enter the air heater through the gas inlet duct 26, flow through the rotor where heat is transferred to the rotor and then exit through gas outlet duct 28. The countercurrent flowing air enters through an air inlet duct 30, flows through the rotor where it picks up heat and then exits through air outlet duct 32. The basket modules 22 containing the heat exchange surface are the typical modules used in air preheaters except that they contain the heat exchange surface of the present invention.

Figure 2:
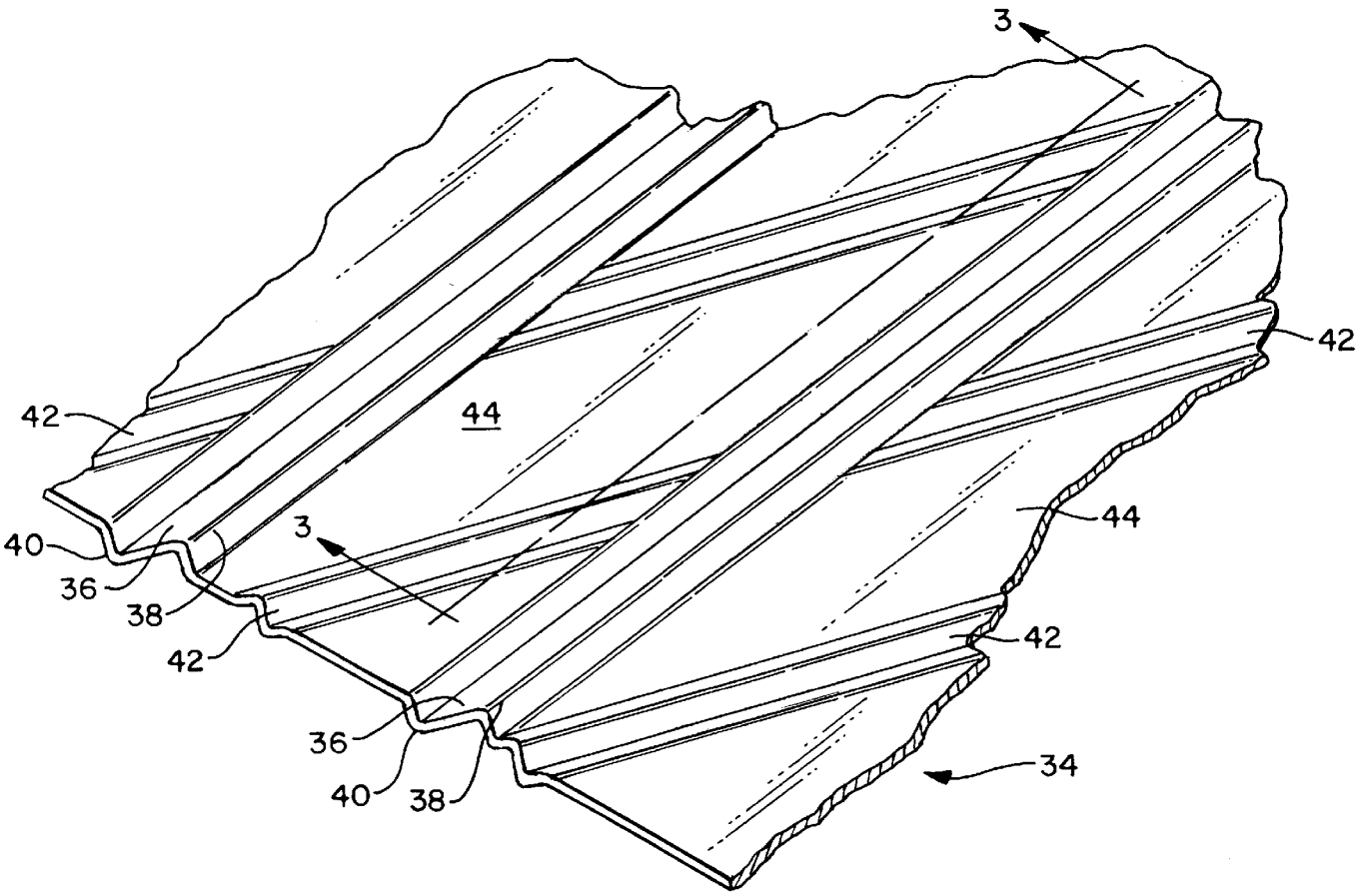
FIG. 2 is a perspective view of one of the plates of the present invention.

FIG. 2 shows a perspective view of one heat transfer plate 34 of the present invention. The plate 34 contains a first series of spaced notches 36 which are generally parallel to the direction of fluid flow through the air preheater and over the plate. The preferred orientation to the nominal flow direction is at zero degrees but it could be +1–3 degrees. Each notch comprises two adjacent portions or ridges 38 and 40 projecting from the plane of the plate with portion 38 projecting from one side of the plate and portion 40 projecting from the other side.

Figure 3:
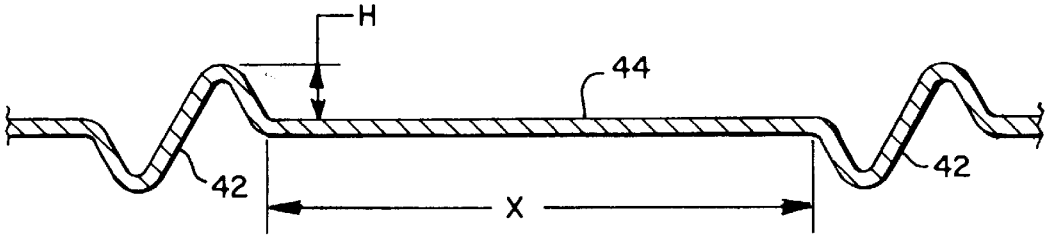
FIG. 3 is a cross section of the plate of FIG. 2 taken along the line 3—3.

The second series of notches comprise the oblique or angled notches 42 which are parallel to each other and extend at an angle between adjacent ones of the straight notches 36. The oblique notches 42 may be at an angle of 10 to 50 degrees from the flow direction. The oblique notches 42 are separated from each other by the flat sections 44. As shown in FIG. 3, which is a cross-section view taken along line 3—3 of FIG. 2, the flat sections 44 have a dimension "X" between notches 42. As also shown in FIG. 3, the notches 42 have a height above the plane of the plate of "H" . This dimension H is referred to as the roughness height. In the present invention, the dimension X is at least 3H and more typically 10H to 40H. An optimum value for X is expected somewhere in the range of 3H to 40H, since the heat transfer literature contains studies of somewhat different geometries where the optimum X is in the range of 10H to 20H. This is due to the fact that it takes a certain distance for the disrupted boundary layer to re-attach itself to the flat section of the plate and then thicken again before it needs another disruption. If X is too small, flow re-attachment doesn't occur, and if X is too large, the heat transfer rate is lower due to the lack of boundary layer disruptions.

Figure 4:
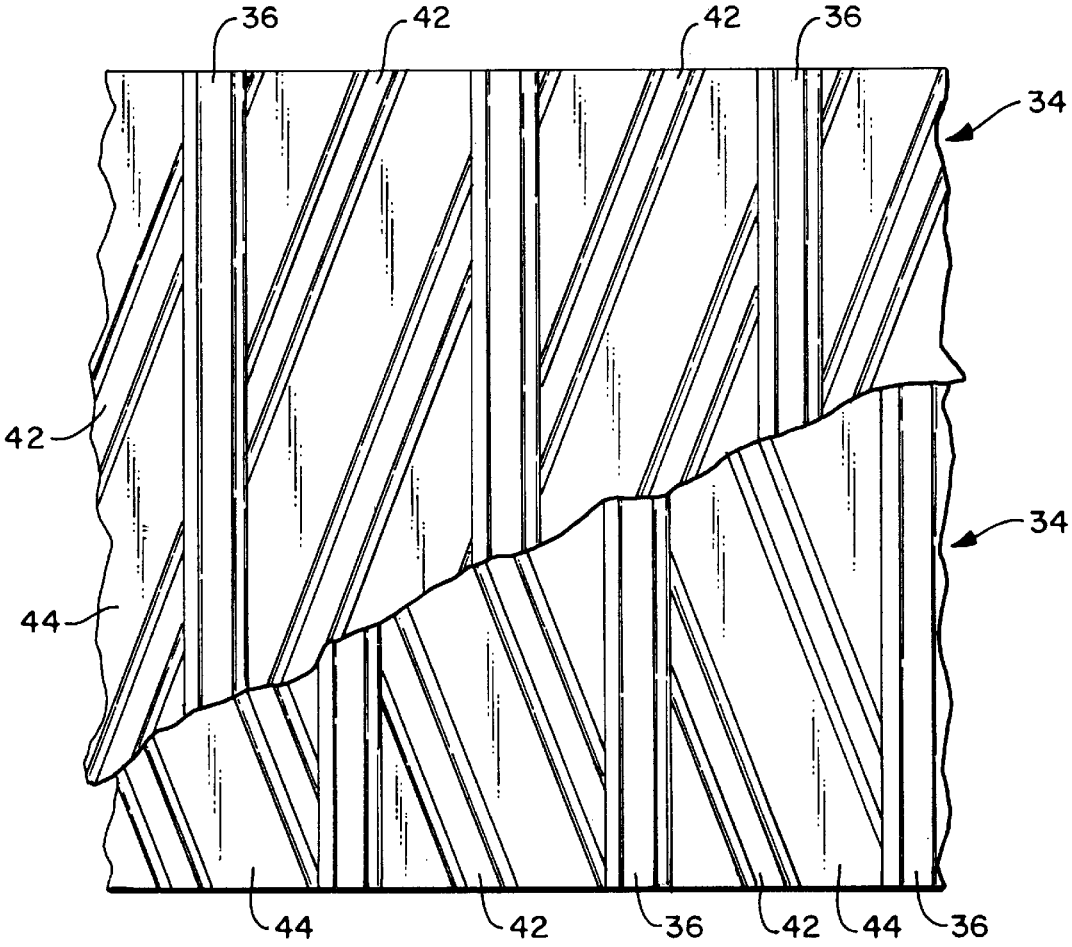
FIG. 4 is a face view of two of the heat transfer plates stacked with the first plate broken away to show the second plate.

FIG. 4 shows a stack of two of the plates of FIG. 2 with all of the plates being identical but with alternate plates being rotated prior to stacking to obtain the notch pattern illustrated in FIG. 4. The height of the straight notches 36 is equal to or preferably higher than the height of the oblique notches 42 such that the straight notches make contact with and are supported by the crests of the angled notches. When the straight notches 36 are higher than the oblique notches 42, an open channel is created between the plates. This open channel provides a line of sight through the pack for infrared hot spot detection. It also provides a path for particulates to be swept through the element pack in a direction parallel to the bulk fluid flow.

Figure 5:
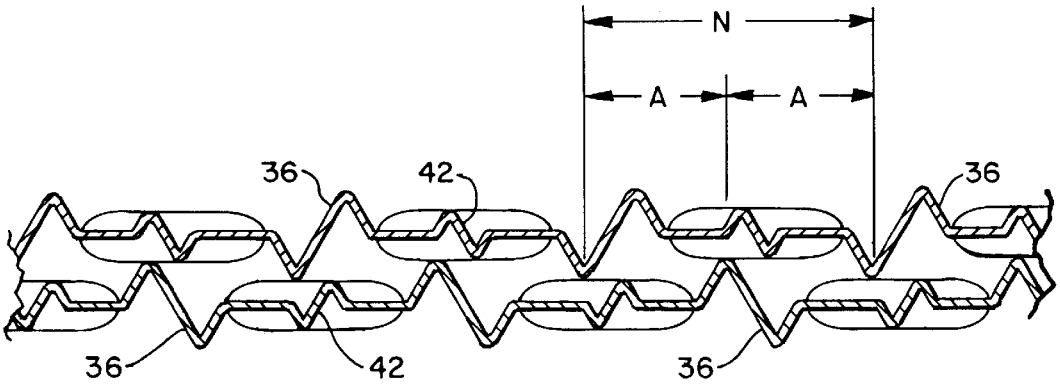
FIGS. 5 and 6 are cross section views showing two different ways to stack the plates.
Figure 6:
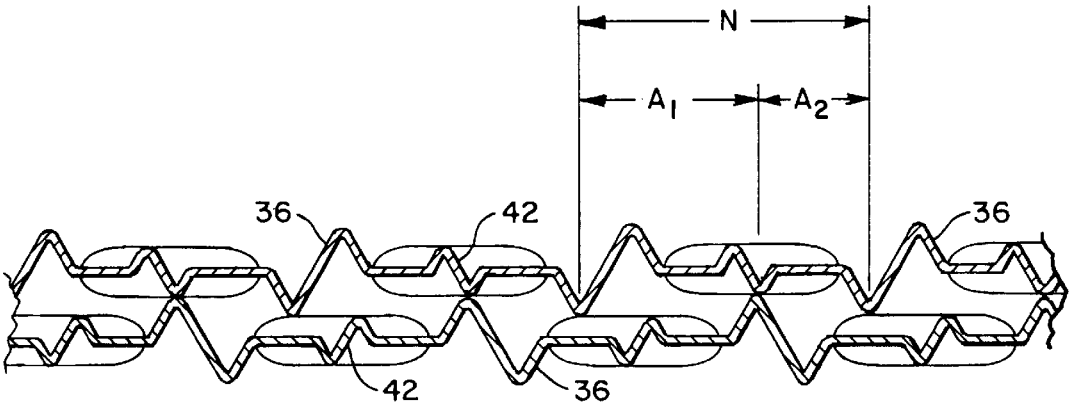

FIGS. 5 and 6 illustrate two different arrangements for stacking the plates 34. FIG. 5 is the preferred stacking arrangement with equal open areas. As shown, the distances between notches 36 is "N" and the open area between notches on adjacent plates is "A". In FIG. 6, the distance N is the same but the open area between engaging notches on adjacent plates is now $A_1$ and $A_2$ which are unequal.

Figure 7:
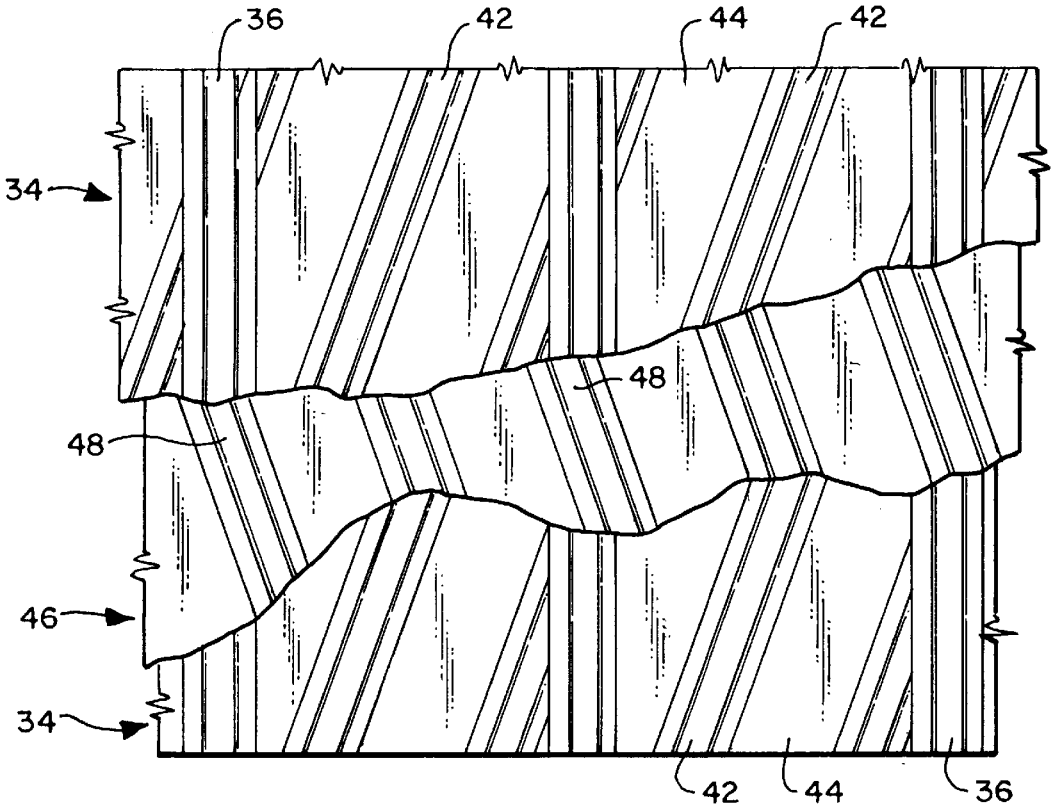
FIG. 7 is a face view of three stacked plates broken away to show each plate.
Figure 8:
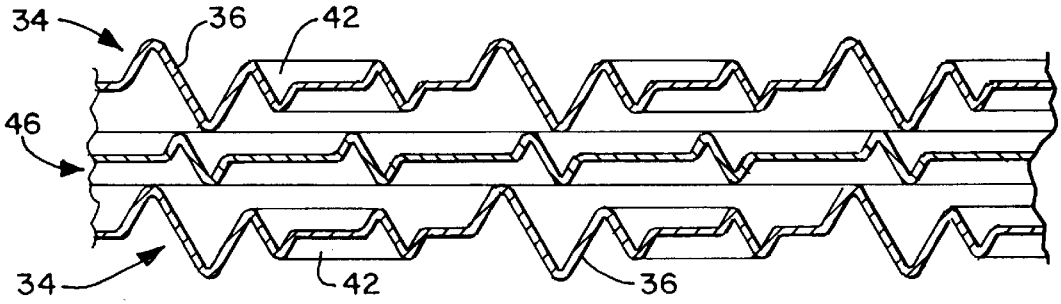
FIG. 8 is a cross section view of the stacked plates of FIG. 7.

FIGS. 7 and 8 illustrate an alternate embodiment of the present invention where two types of plates are employed in an alternating arrangement. The plates 34 are the same as the plates 34 of the embodiments already shown and described in reference to FIGS. 2 to 6 and contains the two types of notches 36 and 42 and the flat portions 44. The second type of plate are the plates 46 which are sandwiched between each of the plates 34. These plates 46 contain the oblique notches 48 which are the same as or similar to the oblique notches 42. However, these plates 46 do not have any straight notches comparable to the straight notches 36 on the plates 34. In the preferred embodiment, the oblique notches 48 have the same dimensions as the oblique notches 42 including angle, height and notch-to-notch spacing. Once again, the preferred arrangement is to have the height of the straight notches greater than the height of the oblique notches 42 and 48.

Although the direction of the oblique notches alternate in the illustrated preferred embodiments of the invention, this is not essential to the invention. An advantage of the oblique notches in combination with the straight notches is that the oblique notches slope towards an area which is more open formed at the intersections of the straight and oblique notches. This "valley" is formed by the flattening of the oblique notches when the straight notches are formed. This more open area provides a path to clear particulates or deposits out of the pack during soot blowing or water washing.

The thermal and pressure drop performance of the pack can be optimized to a specific design condition since the hydraulic diameter can be varied independent of the roughness created by the oblique notches. That is, the height of the straight notches and thus the plate spacing can be increased or decreased as desired while maintaining a constant or even reduced oblique notch height. That is not possible in design where the oblique notches determine the plate spacing.

The plates of the present invention are inherently very rigid. The plates are first reinforced by the straight notches and then further reinforced by the oblique notches. One advantage is that the plates can be placed loosely in the basket since tight packing to maintain support for the plate is no longer necessary. This loose packing feature allows the plates to shake or flex during soot blowing or high pressure water washing to help fracture and loosen the deposits on the plates.

The plates with both straight and oblique notches can be produced by passing the raw metal stock either through one notching roll operation with the rolls having a pattern which forms both types of notches at once or by using two distinct notching roll operations. There is some benefit to this latter method since when the oblique notches are formed first, the second notching operation for the straight notches flattens or locally removes the oblique notch that some bit of roughness from the oblique notch remains on the straight notch for purposes of boundary layer interruption.

While preferred embodiments of the present invention have been illustrated and described in detail, it should be readily appreciated that many modifications and changes thereto are within the ability of those of ordinary skill in the art. Therefore, the appended claims are intended to cover any and all of such modifications which fall within the true spirit and scope of the invention.

We claim:

1. A heat transfer element for a rotary regenerative heat exchanger having a rotor wherein said heat transfer element comprises a plurality of stacked and spaced heat exchange plates arranged in said rotor to form channels therebetween for fluid flow in a direction generally axially through said rotor, said heat exchange plates comprising a series of first heat exchange plates alternating with a plurality of second heat exchange plates, each of said first heat exchange plates comprising:

a plurality of straight notches formed therein at spaced intervals in a direction generally parallel to said direction of fluid flow and a plurality of oblique notches formed therein at parallel spaced intervals and separated by flat portions of said first heat exchange plate, said oblique notches extending at an angle to said straight notches and to said direction of fluid flow and extending between adjacent straight notches, and each of said second heat exchange plates containing no straight notches and comprising:

a plurality of oblique notches formed therein at parallel spaced intervals and separated by flat portions of said second heat exchange plate and extending at an angle to said direction of fluid flow across said second heat exchange plate.

2. A heat transfer element as recited in claim 1 wherein said angle formed between said oblique notches and said direction of fluid flow on adjacent first and second heat exchange plates extend at opposite angles to said direction of fluid flow.

* * * * *